US007334706B2

(12) United States Patent
Schroeder et al.

(10) Patent No.: US 7,334,706 B2
(45) Date of Patent: Feb. 26, 2008

(54) METHOD AND APPARATUS FOR CLEANSING A MIXING DEVICE DURING A DISPENSE

(75) Inventors: Alfred A. Schroeder, San Antonio, TX (US); Michael T. Romanyszyn, San Antonio, TX (US)

(73) Assignee: Lancer Partnership Ltd., San Antonio, TX (US)

( * ) Notice: Subject to any disclaimer, the term of this patent is extended or adjusted under 35 U.S.C. 154(b) by 0 days.

(21) Appl. No.: 11/021,116

(22) Filed: Dec. 22, 2004

(65) Prior Publication Data

US 2006/0131336 A1 Jun. 22, 2006

(51) Int. Cl.
*B67D 1/08* (2006.01)

(52) U.S. Cl. ..... 222/148; 222/1; 222/52; 222/56; 222/59; 222/64; 222/145.5; 222/145.6; 222/129.1

(58) Field of Classification Search ..... 222/148, 222/145.5, 145.6, 1, 129.1, 133, 129.2, 134, 222/129.3, 135, 129.4, 52, 56, 59, 64
See application file for complete search history.

(56) References Cited

U.S. PATENT DOCUMENTS 4,194,650 A * 3/1980 Nottke et al. ..... 222/57
4,341,327 A * 7/1982 Zeitz ..... 222/63
4,886,190 A * 12/1989 Kirschner et al. ..... 222/57
5,033,644 A * 7/1991 Tentler ..... 222/57
5,292,543 A * 3/1994 Heath et al. ..... 426/506
5,749,494 A * 5/1998 Wolski et al. ..... 222/129.1
5,975,365 A * 11/1999 Hsieh ..... 222/129.4
6,669,053 B1 * 12/2003 Garson et al. ..... 222/61
6,915,926 B2 * 7/2005 Naik ..... 222/146.6

* cited by examiner

*Primary Examiner*—Frederick C. Nicolas
(74) *Attorney, Agent, or Firm*—Christopher L. Makay

(57) ABSTRACT

A reconstituting device including a control system reconstitutes product concentrates. The reconstituting device is further able to pre-wet a mixing device of the dispense circuit, dispense the reconstituted product, and rinse the mixing device during a dispense interval without affecting the mix ratio of the reconstituted dispense. Pre-wetting and rinsing of the mixing device of the dispense circuit is accomplished by moving a portion of a concentrate dispense from an earliest and a latest dispense interval to a mid-range dispense interval, thereby flowing reconstituting fluid alone during the earliest and latest dispense intervals. Pre-wetting allows the reconstituting fluid to form a boundary layer on contact surfaces of the mixing device. Rinsing is accomplished by flowing reconstituting fluid through the mixing device after the mixing sequence of the dispense is completed. The control system may conduct the pre-wet or the post-rinse sequence, or may conduct both within a same dispense.

19 Claims, 3 Drawing Sheets

METHOD AND APPARATUS FOR CLEANSING A MIXING DEVICE DURING A DISPENSE

BACKGROUND OF THE INVENTION

1. Field of the Invention

The present invention relates to reconstituting fluids and, more particularly, but not by way of limitation, to methods for cleansing a mixing device during a dispense interval.

2. Description of the Related Art

In the area of product dispensing, products are often reduced to a concentrate to reduce shipping costs. The concentrated product is then packaged and distributed for use. Concentrates are typically reconstituted with a product or beverage dispenser for consumption. In use, the product or beverage dispenser provides control of a reconstituting fluid stream and a concentrate stream to ensure that the concentrate is reconstituted in the correct proportions, thereby creating an in-specification product.

It is often difficult to reconstitute and dispense products in a safe and sanitary manner. Properties of the concentrated product, as well as the reconstituted product, may require that product be refrigerated or protected from the environment. Proper handling and refrigeration of the unstable product is routinely accomplished, however, the delivery of products and product concentrates from the protected environment can be challenging.

Reconstituted products are often delivered to a consumer's cup through a dispensing nozzle of some form. Dispensing nozzles typically protrude from the product dispenser to create a dispense point exterior to the protected environment, as well as the product dispenser. Often, the dispensing nozzles hold product for a next dispense. At least some of the product in those nozzles is exposed to ambient conditions, thereby increasing the chances of evaporation, residues, and spoilage.

In cases where the nozzle does not hold product, residues may still form where the concentrate touches and clings to the interior surfaces of the mixing device, thereby creating areas that may lead to bacterial growth.

A method and apparatus that cleanses a mixing device within the interval of a dispense would be beneficial to product dispenser manufacturers, the processors of unstable product concentrates, and consumers that utilize the product dispensers.

SUMMARY OF THE INVENTION

In accordance with the present invention, a reconstituting apparatus comprises a mixing device and a control system that regulates delivery of a product concentrate from a product concentrate source and a reconstituting fluid from a reconstituting fluid source to the mixing device, whereby the control system delivers the reconstituting fluid for a predetermined interval before the product concentrate, thereby pre-wetting the mixing device. The control system may further stop the delivery of the product concentrate and continue delivery of the reconstituting fluid for a predetermined interval, thereby rinsing the mixing device.

It is therefore an object of the present invention to provide a control system that provides a pre-wet sequence within a product dispense.

It is a further object of the present invention to create a film on interior surfaces of a mixing device before dispensing.

It is still further an object of the present invention to provide a control system that provides a post-rinse sequence within a product dispense.

It is still yet further an object of the present invention to provide a rinse of the interior surfaces of a mixing device during a dispense interval.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

A reconstituting device including a control system provides the ability to reconstitute concentrated products. In the reconstitution process, the reconstituting device further is able to pre-wet a mixing device of the dispense circuit, dispense the reconstituted product, and rinse the mixing device during a dispense interval without affecting the mix ratio of the reconstituted dispense. Pre-wetting and rinsing of the mixing device of the dispense circuit is accomplished by moving a portion of a concentrate dispense from an earliest and a latest dispense interval to a mid-range dispense interval, thereby flowing reconstituting fluid alone during the earliest and latest dispense intervals. Pre-wetting allows the reconstituting fluid to form a boundary layer on the contact surfaces of the mixing device. Rinsing of the mixing device is accomplished by flowing reconstituting fluid through the mixing device after the mixing sequence of the dispense is completed. The control system may conduct the pre-wet sequence and the post-rinse sequence separately, or may conduct both within the same dispense.

Figure 1:
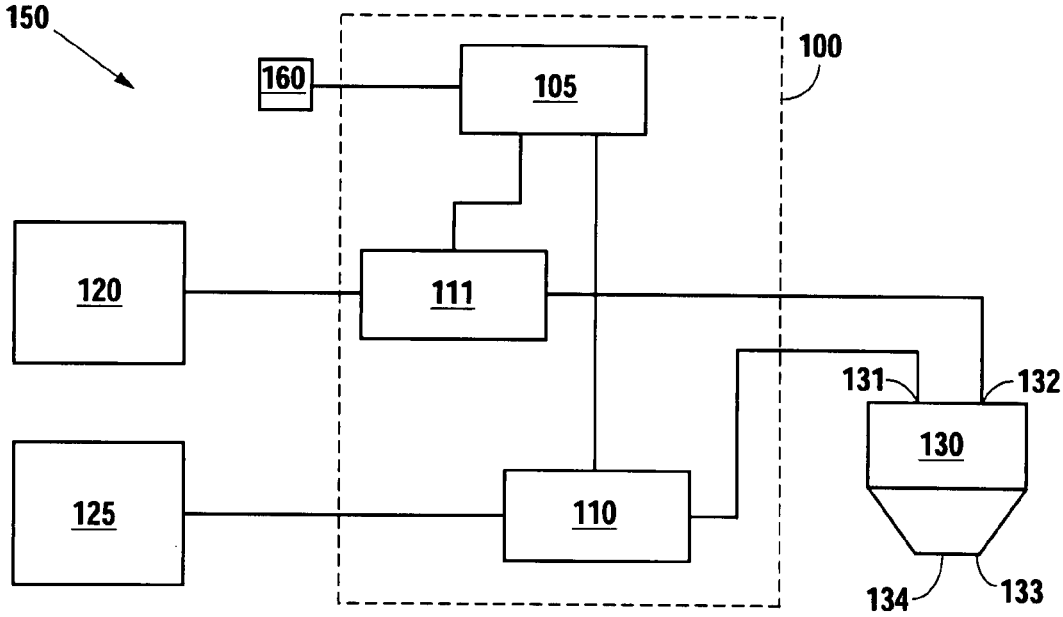
FIG. 1 provides a block diagram of a control system according to the preferred embodiment.

As shown in FIG. 1, a reconstituting apparatus 150 includes a control system 100, a product source 120, a reconstituting fluid source 125, and a mixing device 130. The control system 100 includes a controller 105, a signal input device 160, a first flow control 110 in communication with the controller 105, and a second flow control 111 also in communication with the controller 105. The signal input device 160 may be any type of signal creation device, including membrane switches, buttons, levers, or the like, such that an operator may input a signal to the control system 100 through the signal input device 160. The signal input device 160 is in communication with the control system 100, such that a signal provided to the signal input device 160 is recognized by the control system 100. The first and second flow controls 110 and 111 may be any type of flow stopping and starting devices commonly utilized in the control of fluids and fluid flows, such as solenoid actuated valves, ball valves, and the like. The controller 105 may be any control device that can provide a time delay function, for example, timers, processing devices and associated software, as well as mechanical delay mechanisms. The controller 105 delivers control signals to the first and second flow controls 110 and 111, and may be stand-alone or may be integrated into a more complex control scheme.

The product source 120 may be any form suitable for staging a product for use, for example, plastic packaging, bag-in-box, hard packages, pressurized containers, etc. In most instances, the product source 120 is a disposable product package filled with a product. The product is delivered through an opening in the product package to be reconstituted. The product source 120 is in fluid communication with the second flow control 111, such that the second flow control 111 regulates the flow of the product form the product source 120.

The reconstituting fluid source 125 may be any suitable form of providing a diluent, including pressurized municipal water systems, storage tanks, or the like. The reconstituting fluid source 125 is in communication with the first flow control 110, such that the first flow control 110 regulates the flow of the reconstituting fluid from the reconstituting fluid source 125 to the reconstituting apparatus 150.

The mixing device 130 includes at least two inlet ports: a first port 131 and a second port 132. The mixing device 130 further includes at least one outlet 133. The mixing device 130 may be any suitable device utilized for mixing products, including dispensing valves, air-mix nozzles, and mixing pumps. Typically, the mixing device 130 receives a product concentrate stream and a reconstituting fluid stream, and creates interaction between the two streams to reconstitute the product concentrate. The interaction between the two streams may take place interior to the mixing device 130 in a mixing area 134 or exterior to the mixing device 130 as accomplished in air-mix nozzles commonly used in the beverage dispensing industry.

The second flow control 111 is in fluid communication with the product source 120 and the second port 132 of the mixing device 130, such that the second flow control 111 regulates the flow of product from the product source 120 to the mixing device 130. The first flow control 110 is in fluid communication with the reconstituting fluid source 125 and the first port 131 of the mixing device 130, such that the first flow control 110 regulates the flow of reconstituting fluid from the fluid source 125 to the mixing device 130.

In use, an operator provides a signal to the signal input device 160. After notation of the signal input, the control system 100 effects the opening of the first and second flow controls 110 and 111 to allow product from the product source 120 and the reconstituting fluid from the reconstituting fluid source 125 to be delivered to the mixing device 130.

In this configuration, the control system 100 may open either one or both of the flow controls 110 and 111 in order to deliver either product concentrate, reconstituting fluid, or a mixture thereof. When both the product concentrate stream and the reconstituting fluid stream are flowing, the reconstituting fluid stream impinges the concentrated product stream in the mixing area 134 of the mixing device 130 or exterior thereto. The product concentrate is reconstituted and then delivered to an operator's cup for consumption at a pre-determined mix ratio. Incorrect mixing ratios can lead to weak servings or strong servings, each of which is detrimental to the consumer and the manufacturers of the concentrated product.

The delivery of reconstituting fluid alone provides a rinse for the interior components of the product delivery system. Rinsing before a mixing sequence is defined as a pre-wet sequence. Rinsing after a mixing sequence is referred to as a post-rinse. In this preferred embodiment, the control system 100 conducts a pre-wet sequence and a post-rinse sequence within the duration of a dispense without affecting the mix ratio of the dispensed product. In summary, when an operator dispenses a serving, the control system 100 executes a pre-wet sequence, a mixing sequence, and a post-rinse sequence within the dispense interval.

In the pre-wet sequence, reconstituting fluid is delivered into the first port 132 of the mixing device 130 for a predetermined interval before the entry of product concentrate into the mixing device 130. The pre-wet sequence allows the reconstituting fluid to create a boundary layer on the contact surfaces of the mixing device 130, including any mixing areas 134. The boundary layer prevents product concentrate from contacting the interior walls of the mixing device 130 during the mixing sequence, thereby minimizing the chances of particulates clinging to the interior surfaces and residues associated therewith. In this preferred embodiment, the duration of the pre-wet sequence is in the range of several microseconds. One of ordinary skill in the art will recognize that the duration of the pre-wet sequence is variable depending upon the type of mixing device, the type of product, the duration of the dispense, product mix ratios, and the like.

The mixing sequence follows the pre-wet sequence. In the mixing sequence, both the product concentrate stream and the reconstituting fluid stream are flowing into the mixing device 130. The mixing device 130 forces the reconstituting fluid to impinge the product concentrate, thereby reconstituting the concentrated product stream. As a portion of the reconstituting fluid required for a dispense has been utilized during the pre-wet sequence, the mix ratios may require adjustment to compensate for the previously dispensed reconstituting fluid. In such cases, the amount of product concentrate dispensed per unit time will be increased to ensure that the proper amount of concentrate is dispensed over the full dispense interval.

After the mixing sequence, a post-rinse sequence is conducted to further provide a cleansing aspect. The post-rinse sequence consists of stopping the product concentrate stream before the end of the dispense, thereby allowing the reconstituting fluid to flow over the contact surfaces of the mixing device 130. The flowing of only reconstituting fluid through the mixing device 130 after the mixing sequence aids in the removal of product concentrate portions still within the mixing device 130, as well as portions located near or on the outlet 103. In this preferred embodiment, the duration of the post-rinse sequence is in the range of several microseconds. One of ordinary skill in the art will recognize that the duration of the post-rinse sequence is variable depending upon the duration of the dispense, product viscosity, product mix ratios, product content, and the like.

Figure 2:
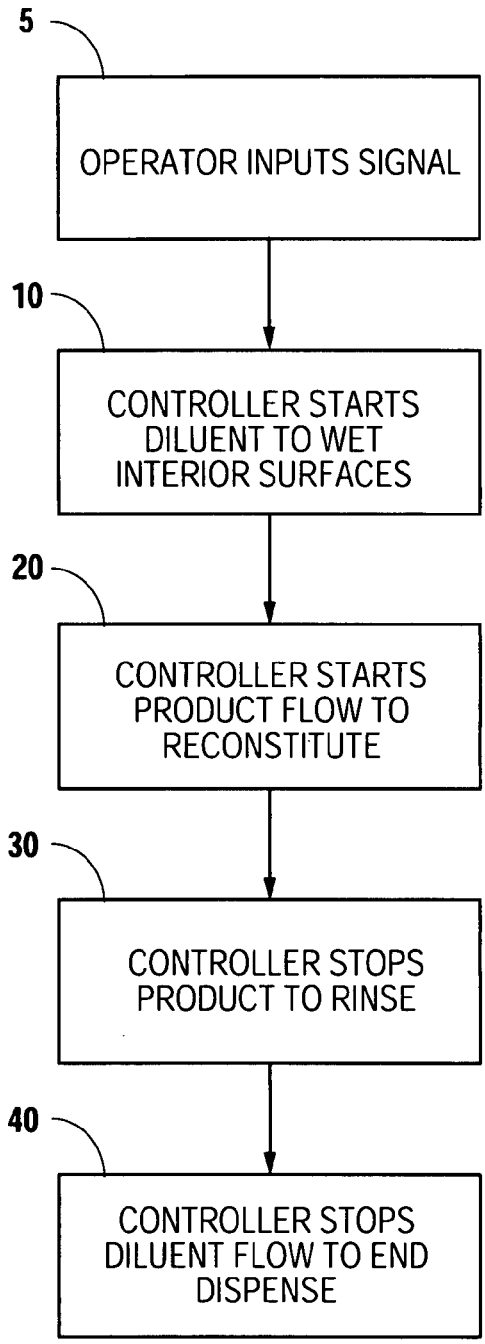
FIG. 2 provides a method flowchart for cleansing during a dispense routine according to the preferred embodiment.
Figure 3:
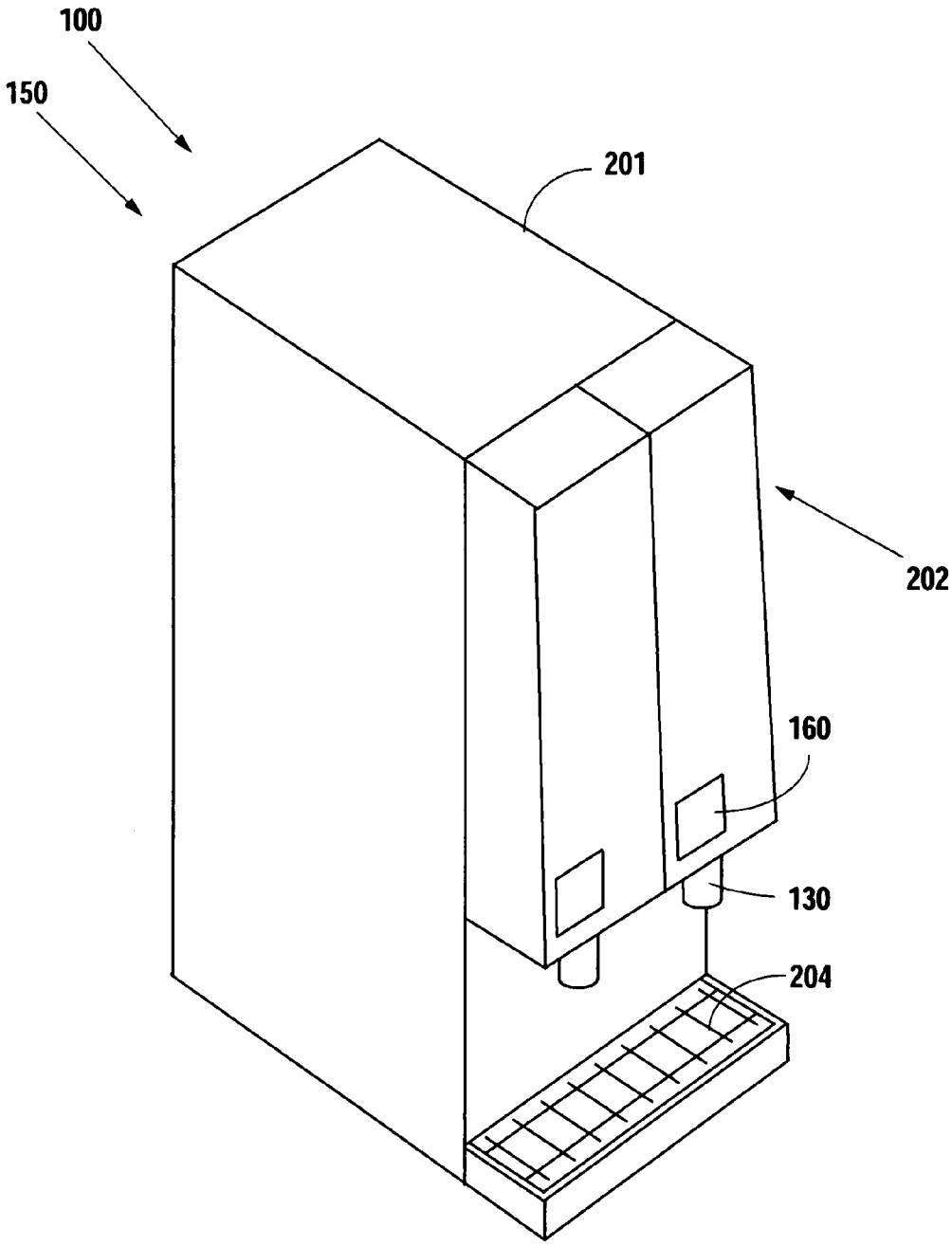
FIG. 3 provides a perspective view of a product dispenser utilizing the preferred embodiment.

In operation, the operator inputs a signal to the signal input device 160, thereby notifying the control system 100 that a dispense is required, as shown in step 5 of the method flowchart of FIG. 2. The control system 100 issues a command to open the first flow control 110 for a predetermined interval as shown in step 10. The first flow control 110 opens to allow the flowing of the reconstituting fluid into the first port 131 of the mixing device 130, thereby conducting a pre-rinse on the surfaces of the mixing device 130. After a predetermined interval, the process moves to step 20, wherein the control system 100 provides an open signal to the second flow control 111, thereby commencing the flow of product concentrate to the second port 132 of the mixing device 130. The mixing device 130 forces the flow of reconstituting fluid to impinge the product concentrate stream, thereby reconstituting the concentrated product. After a predetermined amount of product has been delivered, the control system 100 provides the second flow control 111 with a close signal, thereby stopping the flow of the product concentrate stream, step 30. Ceasing the flow of the product concentrate stream defaults the system to a post-rinse sequence. The rinse sequence continues for a predetermined interval. Once the predetermined interval has expired, the control system 100 instructs the first flow control 110 to close as shown in step 40, thereby ending the dispense.

While the preferred embodiment has been shown with a predetermined dispense interval, it should be clear to one skilled in the art that the preferred embodiment may be utilized with various types of product dispensing schemes, including push and hold dispenses, preprogrammed dispenses, and flavor injection schemes.

In an alternative embodiment, the reconstituting apparatus 150 may be utilized in a product dispenser 200 to reconstitute and dispense products into a consumer's cup. In this case, the mixing device 130 may be fixtured to a housing 201 of the product dispenser 200 such that an operator may place a cup on a cup rest 204 and beneath a mixing device 130 for filling. The product dispenser 200 may contain a protected and controlled interior compartment 202 for products that must be refrigerated. Mixing devices 130 may provide a breach between an interior compartment 202 and the ambient environment as disclosed in U.S. patent application Ser. No. 10/869122, filed on Jun. 16, 2004. Use of a mixing device that does not hold product for a next dispense is conducive to pre-wetting and post-rinsing as a cleansing method. The control system 100 may conduct all functions for the product dispenser 200 or the reconstituting apparatus 150 may be a self-contained unit. A preferred mode of operation would entail the use of a processing device to conduct the operations in a timely manner. Operation of the reconstituting apparatus 150 in the product dispenser 200 may be identical to that previously disclosed in the method flowchart of FIG. 2.

While this preferred embodiment has been shown utilizing both a pre-wet and a post-rinse sequence, one of ordinary skill in the art will recognize that each sequence may be utilized separately with a mixing sequence to provide at least one aspect of the cleansing or cleansing protection. The mixing ratio of the mixing sequence may require adjustment to compensate for any reconstituting fluid utilized during the pre-wet or the post-rinse sequence, in order that the mixing ratio of the completed dispense be within specification.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

I claim:

1. A reconstituting apparatus, comprising:

a mixing device; and a control system whereby, during a dispense interval, the control system regulates delivery of a product concentrate from a product concentrate source and a reconstituting fluid from a reconstituting fluid source to the mixing device, further whereby the control system commences the dispense interval by delivering the reconstituting fluid for a predetermined interval before the product concentrate, thereby pre-wetting the mixing device.

2. The reconstituting device according to claim 1, whereby, during the dispense interval, the control system delivers the product concentrate and the reconstituting fluid upon the expiration of the predetermined interval.

3. The reconstituting apparatus according to claim 2, whereby the control system ends the dispense interval by stopping the delivery of the reconstituting fluid and the product concentrate.

4. The reconstituting apparatus according to claim 2, whereby, during the dispense interval, the control system stops the delivery of the product concentrate and continues the delivery of the reconstituting fluid for a predetermined interval, thereby rinsing the mixing device, further whereby the control system ends the dispense interval by stopping the delivery of the reconstituting fluid.

5. The reconstituting apparatus according to claim 1, wherein the mixing device forces interaction between the product concentrate stream and the reconstituting fluid stream, thereby reconstituting the product concentrate.

6. The reconstituting apparatus according to claim 5, wherein the product concentrate is reconstituted interior to the mixing device.

7. The reconstituting apparatus according to claim 5, wherein the product concentrate is reconstituted exterior to the mixing device.

8. A reconstituting apparatus, comprising:

a mixing device; and a control system that regulates delivery of a product concentrate from a product concentrate source and a reconstituting fluid from a reconstituting fluid source to the mixing device, whereby, during a dispense interval, the control system:

delivers the product concentrate and the reconstituting fluid, stops the delivery of product concentrate and continues the delivery of the reconstituting fluid for a predetermined interval, thereby rinsing the mixing device, and stops the delivery of the reconstituting fluid, thereby ending the dispense interval.

9. The reconstituting apparatus according to claim 8, whereby the product concentrate and the reconstituting fluid delivered during the dispense interval form a reconstituted product.

10. The reconstituting apparatus according to claim 2, whereby the product concentrate and the reconstituting fluid delivered during the dispense interval form a reconstituted product.

11. The reconstituting apparatus according to claim 8, wherein the mixing device forces interaction between the product concentrate stream and the reconstituting fluid stream, thereby reconstituting the product concentrate.

12. The reconstituting apparatus according to claim 11, wherein the product concentrate is reconstituted interior to the mixing device.

13. The reconstituting apparatus according to claim 11, wherein the product concentrate is reconstituted exterior to the mixing device.

14. A product dispenser, comprising:

a housing;

a mixing device disposed within the housing; and a control system, whereby, during a dispense interval, the control system regulates delivery of a product concentrate from a product concentrate source and a reconstituting fluid from a reconstituting fluid source to the mixing device, further whereby the control system commences the dispense interval by delivering the reconstituting fluid for a predetermined interval before the product concentrate, thereby pre-wetting the mixing device.

15. The product dispenser according to claim 14, whereby, during the dispense interval, the control system stops the delivery of the product concentrate and continues the delivery of the reconstituting fluid for a predetermined interval, thereby rinsing the mixing device, further whereby the control system ends the dispense interval by stopping the delivery of reconstituting fluid.

16. A product dispenser, comprising:

a housing;

a mixing device disposed within the housing; and a control system that regulates delivery of a product concentrate from a product concentrate source and a reconstituting fluid from a reconstituting fluid source to the mixing device, whereby, during a dispense interval, the control system:

delivers the product concentrate and the reconstituting fluid, stops the delivery of the product concentrate and continues the delivery of the reconstituting fluid for a predetermined interval, thereby rinsing the mixing device, and stops the delivery of the reconstituting fluid, thereby ending the dispense interval.

17. A method of cleansing a mixing device during a dispense, comprising:

a. commencing a dispense interval by flowing for a predetermined interval a reconstituting fluid through a mixing device to wet the interior surfaces of the mixing device;

b. flowing a product concentrate through the mixing device at the expiration of the predetermined interval to interact with the reconstituting fluid and reconstitute the product concentrate; and c. stopping the flows of the reconstituting fluid and the product concentrate, thereby ending the dispense interval.

18. The method of cleansing a mixing device during a dispense according to claim 17, wherein step c. is replaced with:

c. stopping the flow of the product concentrate through the mixing device, such that the flowing reconstituting fluid rinses the interior surfaces of the mixing device to provide a cleansing function; and d. stopping the flow of the reconstituting fluid after a predetermined interval, thereby ending the dispense interval.

19. A method of cleansing a mixing device during a dispense, comprising:

a. flowing a reconstituting fluid through a mixing device;

b. flowing a product concentrate through the mixing device to interact with the flow of reconstituting fluid and create a reconstituted product;

c. stopping the flow of the product concentrate through the mixing device, such that the flowing reconstituting fluid rinses the interior surfaces of the mixing device to provide a cleansing function; and d. stopping the flow of the reconstituting fluid after a predetermined interval, thereby ending a dispense interval.

* * * * *